US005184910A

United States Patent [19]

Betsill

[11] Patent Number: 5,184,910

[45] Date of Patent: Feb. 9, 1993

[54] METHOD AND MATERIAL FOR WRITING CHECKS BY APPLYING PRESSURE ON A PREPRINTED OVERLAY

[76] Inventor: Katherine B. Betsill, 5002 N. Via Condesa, Tucson, Ariz. 85718

[21] Appl. No.: 760,589

[22] Filed: Sep. 16, 1991

[51] Int. Cl.[5] ..... B42D 15/00

[52] U.S. Cl. ..... 462/8; 283/67; 283/904; 434/84; 434/88; 464/64; 464/65; 464/84

[58] Field of Search ..... 283/67, 904; 434/81, 434/84, 85, 88; 462/8, 64, 65, 81, 88, 84

[56] References Cited

U.S. PATENT DOCUMENTS

| | | | |
|---|---|---|---|
| 1,608,294 | 11/1926 | Beman . | |
| 2,071,441 | 2/1937 | Varren | 434/88 |
| 2,217,770 | 10/1940 | Gibbs | 434/84 |
| 2,247,222 | 6/1941 | Dale | 283/12 |
| 2,618,077 | 11/1952 | Rotolo | 434/84 |
| 3,111,336 | 11/1963 | Schumacher | 462/64 |
| 3,126,211 | 3/1964 | Hieken et al. | 283/6 |
| 3,186,735 | 6/1965 | Hanrahan | 462/64 |
| 3,306,632 | 2/1967 | Stahmer | 462/65 |
| 3,364,598 | 1/1968 | Cook | 434/88 |
| 3,556,563 | 1/1971 | Scheinberg et al. | 283/67 |
| 3,759,179 | 9/1973 | Guido | 283/904 X |
| 3,790,193 | 2/1974 | McBride | 283/57 |
| 3,802,724 | 4/1974 | Gosnell | 283/9 |
| 3,889,397 | 6/1975 | Flood | 434/88 |
| 3,895,576 | 7/1975 | Fischer | 462/84 X |
| 3,950,013 | 4/1976 | Tagliaferri | 283/6 |
| 3,993,814 | 11/1976 | Cavender | 428/40 |
| 4,696,706 | 9/1957 | Griffin et al. | 434/85 X |
| 4,971,364 | 11/1990 | Templet | 283/70 |

FOREIGN PATENT DOCUMENTS

| | | | |
|---|---|---|---|
| 700347 | 12/1953 | United Kingdom | 434/88 |

*Primary Examiner*—Paul A. Bell

*Attorney, Agent, or Firm*—Antonio R. Durando; Harry M. Weiss

[57] ABSTRACT

A sheet containing the reverse image of printed material on its back side is appropriately positioned to match the blank portions of a conventional check form, so that such material can be transferred to the check by pressing on the front side of the sheet to deposit the printed material on the check. Depending on the specific selection of printed material used, the resulting check may contain all the information required to make a negotiable instrument except, for example, the date and signature, which are left for the maker to insert. The sheet containing such preprinted material may be combined with a statement of account received periodically by a customer from a business entity.

20 Claims, 2 Drawing Sheets

METHOD AND MATERIAL FOR WRITING CHECKS BY APPLYING PRESSURE ON A PREPRINTED OVERLAY

BACKGROUND OF THE INVENTION

1. Field of the Invention

This invention is related to the general field of debit statements and negotiable instruments. In particular, the invention provides a new method and material for preparing negotiable checks by pressing and peeling a preprinted overlay on a conventional check.

2. Description of the Prior Art

People write checks on a regular basis for payment of bills received periodically from utilities and other service companies. In fact, in many instances the majority of the checks written by individuals are in response to computerized monthly statements automatically sent out by the entities with which the individual is doing business. Therefore, a check with the same hand-written information except for the date and the maker's signature must be prepared every month for each such business entity, necessitating considerable repetitive effort.

This invention is directed at minimizing such effort. Specifically, it seeks to provide a vehicle for including all the information required to prepare a negotiable instrument directly with the monthly statement, so that it can be used by the recipient while making the monthly payment by check. In addition to the convenience, this method would ensure that the proper payee, amount and account information are automatically entered on the check without possibility of mistake on the part of the maker.

Several patents exist covering methods and devices to achieve this goal. See, for example, U.S. Pat. No. 1,608,294 to Beman (1926), U.S. Pat. No. 2,247,222 to Dale (1941), U.S. Pat. No. 3,126,211 to Hieken et al. (1964), U.S. Pat. No. 3,802,724 to Gosnell (1974), U.S. Pat. No. 3,950,013 to Tagliaferri (1976), U.S. Pat. No. 3,993,814 to Cavender (1976), and U.S. Pat. No. 4,971,364 to Templet (1990). All of these patents disclose inventions designed to facilitate the transmission and protection of financial instruments and records by combining conventional financial paper with various labeling material.

In particular, U.S. Pat. No. 3,790,193 to McBride (1974) discloses a statement/check overlay combination that enables a maker to utilize a preprinted portion of the statement to prepare the check in negotiable form. The invention is intended for use in conjunction with regular billing in order to provide a customer with a ready-made printed form that contains all of the information required to write a check, except for the date and the signature. The printed material in the transparent overlay is formatted to fit in the right place over a conventional check blank, allowing the information on the check to be visible and leaving window spaces for a user to insert the date and signature. Thus, the maker only has to remove a protective layer of material from the adhesive back of the overlay, position it over the check and write in the date and signature through the open windows. The rest of the information is provided in the overlay by the issuer of the statement. The present invention is directed at further simplifying the process of preparing a check from a preprinted form furnished in conjunction with a billing statement by eliminating the necessity of pasting the overlay on the check and by simplifying the overlay's construction.

BRIEF SUMMARY OF THE INVENTION

One objective of this invention is the development of a new method and overlay for transferring preprinted information from a statement to a conventional check form in order to ensure the accuracy and facilitate the making of the check.

Another objective of the invention is an overlay that does not contain an adhesive back for application to a conventional check form and therefore does not require the use of a protective backing in combination with the overlay.

A further goal of the invention is a preprinted form that can be used to transfer printed information without affixing the entire form to the blank check.

A further objective of the invention is a preprinted overlay that is suitable for issuance to a customer in conjunction with a periodic statement of account.

A final objective is the easy and economical manufacture of the overlay according to the above stated criteria by using commercially available techniques and materials.

According to these and other objectives, the present invention consists of a sheet (preferably transparent) containing the reverse image of printed material on its back side, appropriately positioned to match the blank portions of a conventional check form, so that such material can be transferred to the check by pressing on the front side of the sheet to deposit the printed material on the check. Depending on the specific selection of printed material used, the resulting check may contain all the information required to make a negotiable instrument except, for example, the date and signature, which are left for the maker to insert. The sheet containing such preprinted material may be combined with a statement of account received periodically by a customer from a business entity.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

This invention consists of a new type of overlay designed to accomplish all of the functions described by McBride in U.S. Pat. No. 3,790,193, referenced above, in a more practical and economical manner. The method comprises the use of a single sheet of overlay material, attached to the statement of account received by a customer, incorporating on its back side the preprinted information required for preparing a check in payment of the balance due shown on the statement. The preprinted information can be in the form of carbon lettering or equivalent print that is capable of being transferred by pressure by image reversal transfer from the back of the overlay to a surface in direct contact with it. By placing such preprinted information in such a way that it matches the corresponding blank spaces on a standard check form, the overlay enables a user to fill out a check simply by applying pressure on the front of the overlay against the backing of the appropriately positioned face of the check.

Figure 1:
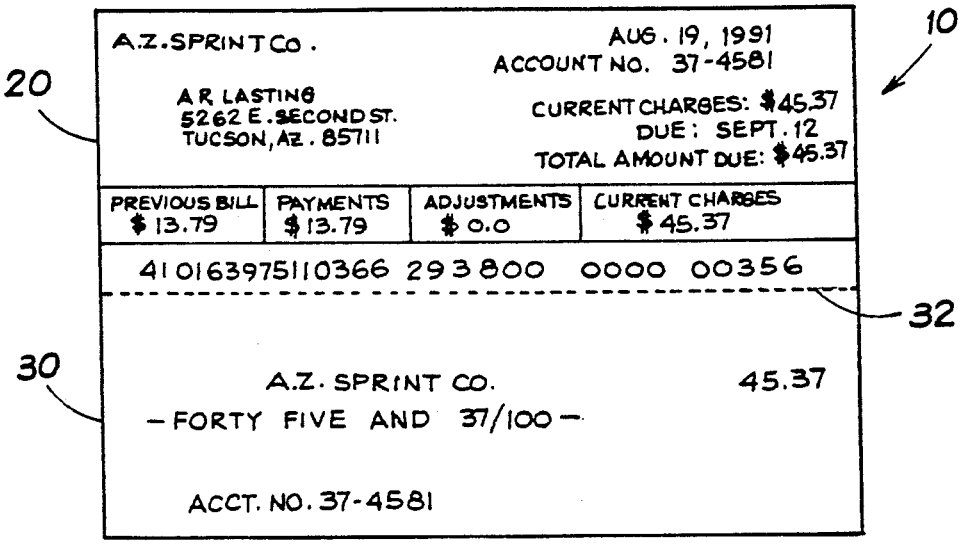
FIG. 1 is an elevational view of a typical statement of account including the overlay of this invention shown as a transparent attachment thereof.

Referring to the drawings, wherein like parts are referred to throughout with like symbols and numerals, FIG. 1 illustrates a statement of account 10 of the type normally received by business customers at the end of each billing cycle. The statement 1 comprises a top portion 20 containing the billing and accounting information normally included with a periodic statement, such as customer information, current charges and balance due. The portion 20 is shown only by way of example and any acceptable business format would be suitable for use in conjunction with this invention, which is directed at the bottom portion attached thereto. The bottom portion of the statement 10 consists of an overlay 30 of the same size of a conventional check. The overlay 30 is illustrated in FIG. 1 as an attachment connected to the top portion 20 along a perforated line 32, from which it can be separated to form a separate component, but this feature is not essential to practice the invention. In fact, so long as the overlay can be placed exactly over the face of a matching blank check, it is irrelevant whether it is or remains connected to the statement or not.

The main feature of the invention is that the overlay 30 contains all the information required to prepare a check in payment of the balance due in the attached statement except for the customer's signature and possibly the date. That information is imprinted on the back side of the overlay in a way that makes it possible to transfer the print to an adjacent surface by applying pressure on the front of the overlay, such as with carbon lettering, transferable ink, rubdown lettering, or any other equivalent means. Of course, the information is imprinted on the back of the overlay in mirror image of the way it is supposed to appear on the check, so that the desired image will be transferred by contact with the check.

Figure 2:
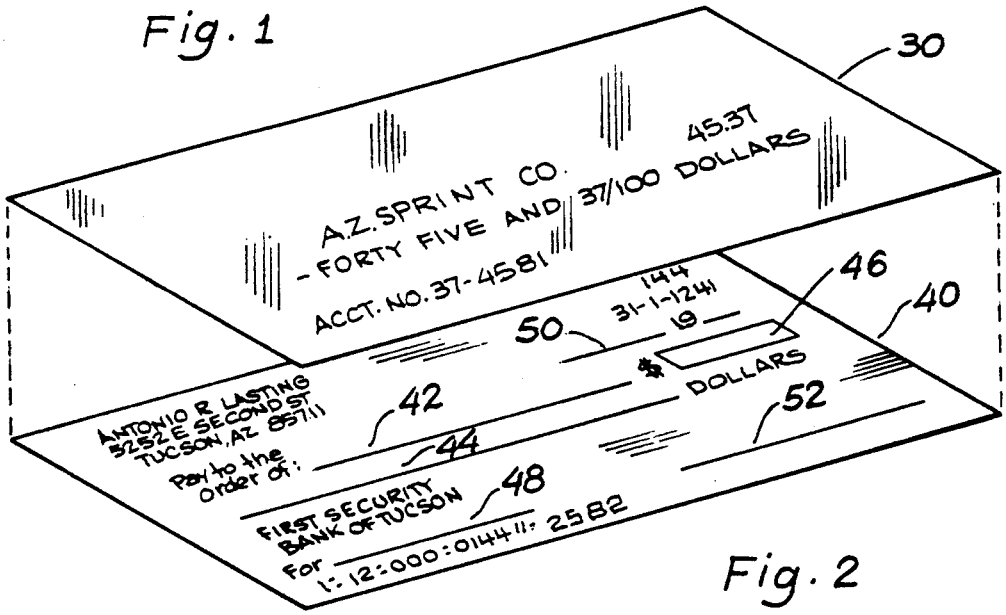
FIG. 2 is a perspective view illustrating the placement of the overlay of this invention on a conventional blank check form so that the printed information on the back of the overlay is placed in contact with the face of the check.

The overlay 30 in FIG. 1 is shown in transparent material in order to allow a user to see the preprinted information on its back and easily line it up with the corresponding blank spaces in a conventional check 40, as illustrated in FIG. 2. The overlay does not have to be transparent, though, in order to practice the invention. So long as a guide is provided, such as a perfectly matching size or a reference edge, to place the overlay in the correct position over the check, any opaque material would be equally suitable. The only critical feature is the ability of a user to line up the overlay with the check before applying pressure, so that the preprinted information is transferred to the blank space for which it is intended.

As illustrated for example in FIG. 2, the overlay 30 (shown detached from the top portion 20 of the statement) contains preprinted information concerning the payee (A. Z. Sprint Co.), the amount due (45.37 and Forty Five and 37/00) and the payor's account number (Acct. No. 37-4581), leaving only the date and signature for writing by the maker of the check. While this information is typical of the data used to fill out blank checks, different information could be used, as might best fit specific situations. For example, a date could also be included in the preprinted overlay, thus leaving only the signature for entry by the maker.

Figure 3:
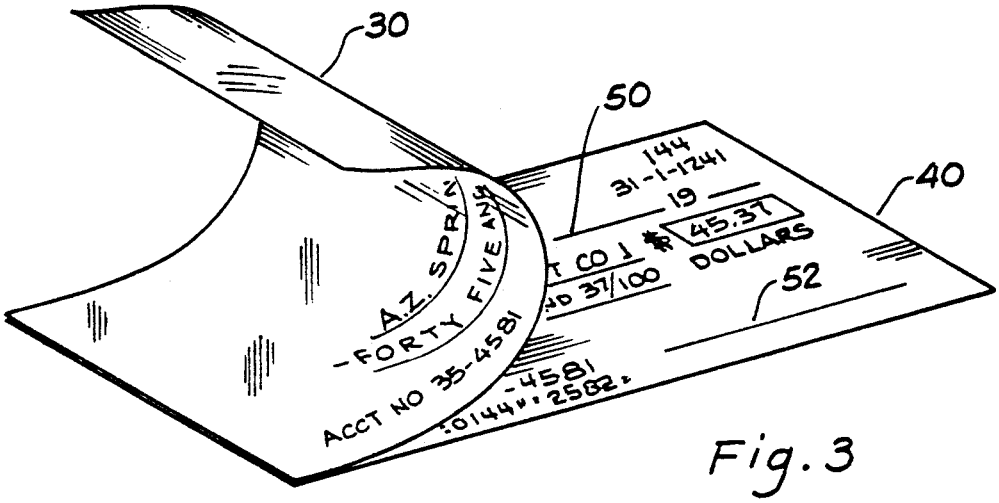
FIG. 3 is a perspective view illustrating the removal of the overlay from the check after transferring the printed information from the back of the overlay onto the face of the check.

It is apparent from FIG. 2 that each preprinted entry on the back of the overlay 30 must be positioned so that it matches a corresponding blank line in the check 40 when the overlay is lined up with the check. For example, the payee (A. Z. Sprint CO.) must line u with the blank line 42; the check amount with lines 44 and 46 for the cursive and numerical entries, respectively; and the account number with the generic memorandum line 48. Thus, by pressing the overlay over the blank check and rubbing over the lines containing the preprinted information, the data are transferred to the check which, after removal of the overlay (shown in FIG. 3), is readily prepared for dating and signing in the corresponding blank lines 50 and 52.

Figure 4:
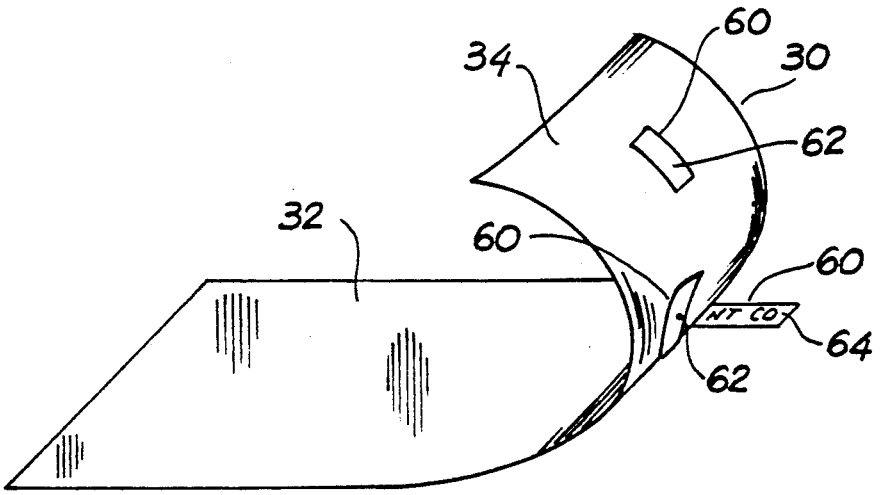
FIG. 4 is a perspective view illustrating a different embodiment of the invention comprising adhesive strip labels incorporating the printed information required to prepare a check.
Figure 5:
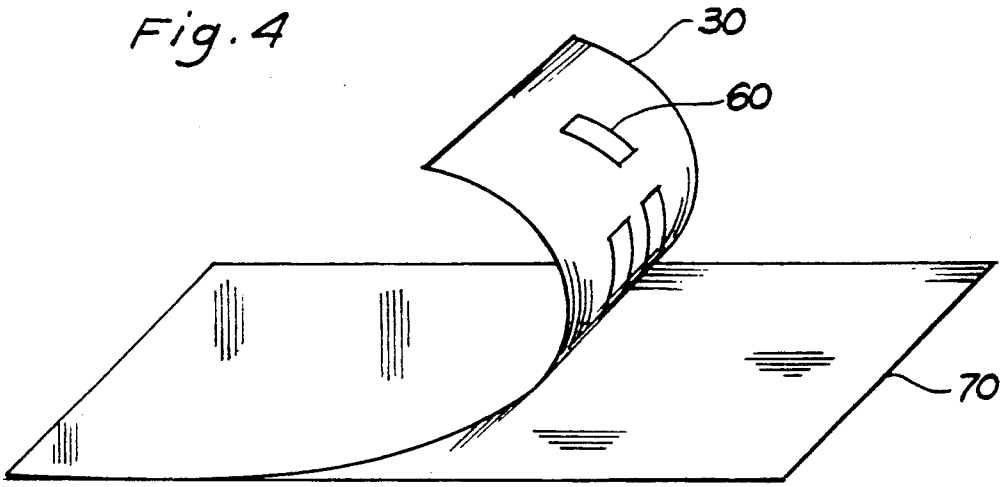
FIG. 5 is a perspective view illustrating the embodiment of FIG. 4 including a protective backing for the adhesive strip labels.
Figure 6:
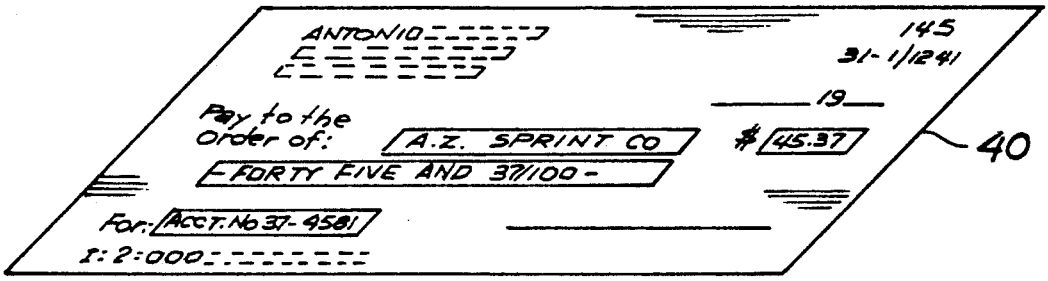
FIG. 6 is a perspective view of a check prepared with the check overlay of FIG. 4.

In a similar embodiment of the invention, which is detailed in FIGS. 4–6, the preprinted data on the back of the overlay may consist of adhesive strip labels 60 attached to the back of the overlay having a very sticky bottom portion 62 for permanent adherence to the check and a slightly sticky top portion 64 for temporary adherence to the back of the overlay. Thus, the top of these preprinted labels is attached to the back of the overlay 30 (instead of actually imprinting the information on it with transferable material, as in the case of the first embodiment) and the bottom of the labels is strongly adhesive, so that it can be easily affixed to the check and remain bonded to it after peeling off the overlay. FIG. 4 shows a detached overlay 30 with an opaque top 32 and preprinted labels 60 removably attached to its bottom 34. As illustrated in the figure, the labels peel off the bottom 34, thus exposing the information printed on their top 64. Since the bottom 62 of the labels is more adhesive than the top 64, the labels will easily transfer to another surface (such as a blank check) simply by contact. Naturally, depending on whether or not the labels come into contact with any material to which they might permanently adhere prior to use, a protective backing 70 of shiny, non-stick material may become necessary in order to avoid losing the labels before use. In that case, the protective backing 70 would be part of the construction of the overlay 30 (or of the entire statement 10) and would need to be peeled off before application of the overlay 30 to a blank check.

Note that equivalent embodiments of the same basic invention can be obtained with any medium suitable for imprinting on the back of an overlay and for transfer by pressure and image reversal onto a surface in contact with it. The most important characteristic of this invention is the ability to transfer preprinted information from the overlay to a check through the single step of applying pressure on the front of the overlay. This distinguishes the invention disclosed in McBride by not requiring the actual attachment of the entire overlay on the check and, at least in its first embodiment, by eliminating the need for a protective backing. Therefore, the invention greatly simplifies the writing of a check by allowing a user to line up the overlay received with the monthly statement with the check, by pressing on it to transfer the preprinted information on the back of the overlay to the appropriate spaces on the check, and by signing the check according to normal practice. If so desired, the date may also be left for entry by the maker of the check.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

I claim:

1. A preprinted check overlay combined with a written statement of account sheet periodically furnished by a business entity to a customer for use in filling out a blank check in payment thereof, comprising:

(a) a written statement of account sheet containing entries corresponding to the name of the business entity and the amount owed by the customer, and (b) a transparent check overlay having a top side and a bottom side; said bottom side containing printed matter in transferrable mirror-image comprising the name of the business entity positioned so as to match the blank space in the check for recording the payee, comprising the amount owed in alphabetical form and positioned so as to match the blank space in the check for recording in alphabetical form the amount paid, and comprising the amount owed in numerical form and positioned so as to match the blank space in the check for recording in numerical form the amount paid;

wherein said mirror-image printed matter on the bottom side of said overlay is transferrable by applying pressure on the top side of said overlay.

2. A preprinted check overlay combined with a written statement of account sheet periodically furnished by a business entity to a customer for use in filling out a blank check in payment thereof, comprising:

(a) a written statement of account sheet containing entries corresponding to the name of the business entity and the amount owed by the customer, (b) a check overlay having a top side and a bottom side and being of sufficient size to contain information required in filling out a blank check;

(c) printed matter incorporated in mirror image on the bottom side of said overlay and positioned so as to match corresponding blank spaces in the check, wherein each item of printed matter consists of information required to fill out the corresponding space in the blank check;

(d) means for aligning said printed matter with the corresponding blank spaces in the check; and (e) means for transferring said printed matter onto the blank check by applying pressure on the top side of said overlay.

3. The preprinted overlay described in claim 2, wherein said printed matter includes entries for the name of the payee, the amount owed expressed in cursive form and the amount owed expressed in numeral form.

4. The preprinted overlay described in claim 2, wherein said check overlay has the same dimensions of the blank check.

5. The preprinted overlay described in claim 2, wherein said check overlay is made of transparent material.

6. The preprinted overlay described in claim 2, wherein said check overlay is attached to the written statement of account sheet periodically furnished by a business entity to its customers.

7. The preprinted overlay described in claim 6, wherein said check overlay is detachable from said statement of account.

8. The preprinted overlay described in claim 2, wherein said printed matter incorporated in mirror image on the bottom side of said overlay and said means for transferring said printed matter onto the blank check by applying pressure on the top side of said overlay consist of transferable ink.

9. The preprinted overlay described in claim 2, wherein said printed matter incorporated in mirror image on the bottom side of said overlay and said means for transferring said printed matter onto the blank check by applying pressure on the top side of said overlay consist of carbon imprint.

10. The preprinted overlay described in claim 2, wherein said printed matter incorporated in mirror image on the bottom side of said overlay and said means for transferring said printed matter onto the blank check by applying pressure on the top side of said overlay consist of preprinted strip labels having the front detachably affixed to the bottom side of said overlay and having an adhesive back.

11. The preprinted overlay described in claim 10, further comprising a protective backing detachably affixed to the back of said preprinted strip labels.

12. A method for preparing a check using a preprinted check overlay provided with a written statement of account sheet periodically furnished by a business entity to a customer, comprising the following steps:

(a) providing a written statement of account sheet containing entries corresponding to the name of the business entity and the amount owed by the customer, combined with a check overlay having a top side and a bottom side, the bottom side containing printed matter corresponding to information required in filling out a blank check; wherein the printed matter is incorporated in mirror image on the bottom side of the overlay and is positioned so as to match corresponding blank spaces in the check; wherein each item of printed matter consists of information required to fill out the corresponding space in the blank check; and wherein the printed matter is capable of transfer onto the blank check by the application of pressure on the top side of the overlay;

(b) aligning the preprinted overlay on top of a blank check so that the location of the printed matter matches corresponding blank spaces in the check; and (c) applying pressure on the top side of the overlay to cause the transfer of the printed matter onto the check.

13. The method described in claim 12, wherein the preprinted overlay provided in step (a) has the same dimensions of the blank check, so that the alignment recited in step (b) is accomplished by aligning the edges of the overlay and of the check.

14. The method described in claim 12, wherein the preprinted overlay provided in step (a) is made of transparent material, so that the alignment recited in step (b) is accomplished by visually aligning the printed matter on the overlay with the corresponding blank spaces on the check.

15. The method described in claim 12, wherein the preprinted overlay provided in step (a) is attached to the statement of account sheet periodically furnished by a business entity to its customers.

16. The method described in claim 15, wherein the preprinted overlay provided in step (a) is detachable from the statement of account sheet.

17. The method described in claim 12, wherein the printed matter provided in step (a) consists of transferable ink.

18. The method described in claim 12, wherein the printed matter provided in step (a) consists of carbon imprint.

19. The method described in claim 12, wherein the printed matter provided in step (a) consists of preprinted strip labels having the front detachably affixed to the bottom portion of said overlay and having an adhesive back.

20. The method described in claim 19, further comprising the step of providing a protective backing detachably affixed to the back of said preprinted strip labels and of removing said protective backing prior to performing step (b).

* * * * *